United States Patent [19]

Murai et al.

[11] 4,388,506

[45] Jun. 14, 1983

[54] CIRCUIT INTERRUPTER

[75] Inventors: Wasaburo Murai, Osaka; Masao Horikawa, Yamato-koriyama, both of Japan

[73] Assignee: Terasaki Denki Sangyo Kabushiki Kaisha, Osaka, Japan

[21] Appl. No.: 323,991

[22] Filed: Nov. 23, 1981

Related U.S. Application Data

[63] Continuation-in-part of Ser. No. 10,139, Feb. 7, 1979, abandoned.

[51] Int. Cl.[3] ..... H01H 33/04; H01H 33/42

[52] U.S. Cl. ..... 200/144 R; 335/201

[58] Field of Search ..... 200/144 R; 335/173, 335/174, 201, 166

[56] References Cited

U.S. PATENT DOCUMENTS

| | | | |
|---|---|---|---|
| 3,483,343 | 12/1969 | Heft | 200/147 R |
| 3,555,471 | 1/1971 | Mitskevich et al. | 200/147 R |
| 3,564,176 | 2/1971 | Fechant | 200/144 R |
| 3,940,723 | 2/1976 | Horikawa | 335/174 |
| 4,001,742 | 1/1977 | Jencks et al. | 335/173 |

FOREIGN PATENT DOCUMENTS

| | | | |
|---|---|---|---|
| 55-124732 | 9/1980 | Japan | 200/144 R |

*Primary Examiner*—Robert S. Macon

*Attorney, Agent, or Firm*—Wenderoth, Lind & Ponack

[57] ABSTRACT

The contact structure and the arc extinguisher means of a circuit interrupter are enclosed in an insulating housing of each pole and the operating mechanism is isolated from the contact structure and located outside of the housing. The housing for each pole forms an arc extinguisher amper with a detachably attached cover containing an arc extinguisher, and a contact chamber containing a contact structure in each pole. An interconnecting rod, located between the contact structure and the operating mechanism has a flange or barrier for covering an opening in the housing through which the rod extends. Upon contact separation, the electric arc increases the internal pressure within the housing, thereby rapidly effecting arc extinction. The dielectric strength between the contact structure and the operating mechanism is also greatly increased in comparison with conventional designs.

5 Claims, 3 Drawing Figures

CIRCUIT INTERRUPTER

CROSS REFERENCE TO RELATED APPLICATIONS

This application is a continuation-in-part of now abandoned application Ser. No. 10,139, filed Feb. 7, 1979.

BACKGROUND OF THE INVENTION

1. Field of the Invention

This invention relates to circuit interrupters, and more particularly to air circuit interrupters.

2. Description of the Prior Art

Air circuit interrupters include a first type having no insulating housing at all and a second type having a molded insulating housing enclosing the entire interrupter mechanism, including its contact structures and operating mechanisms.

The first type of interrupter, having no housing, generally consists of circuit breakers for relatively large rated current capacity and has the advantages that inspection and maintenance are easy and that it does not require an expensive molded case. However, the dielectric strength between the current carrying portion and the operating mechanism is relatively low, and when an electric arc is established between the separated contacts, a leakage current may flow to the operating mechanism. Furthermore, since this type of circuit interrupter does not include a housing, the gas pressure at the arcing region, produced by the heavy current, does not increase sufficiently which causes insufficient gas flow to the arc extinguisher means, as compared to circuit interrupters with an insulating housing. For these reasons, the first type of circuit interrupters, having no housing, is not suitable for handling a large interrupting current within a small volume.

The second type of circuit interrupter has its current carrying portion and operating mechanism enclosed within an insulating housing, so that the pressure within the housing increases to a certain extent upon contact separation, which contributes somewhat to enabling an effective gas glow and a better interrupting performance. Therefore the rated interrupting capability of the second type of interrupter is usually high to a certain extent than that of the first type of interrupter. However, since the entire mechanism, including the contact structure and the operating mechanism, is housed in a single housing, the housing is inevitably relatively large, and it is still insufficient to achieve the desirable gas flow for arc extinction since the arc gas produced around the contact region still tends to spread partially against the arc extinguisher means. Moreover, since the housing is inevitably relatively large and expensive, it tends to be designed within as small dimensions as possible, which reduces the robustness of the operating mechanisms and the contacting force and also causes a reduction of the capability to carry and withstand high fault currents, i.e. so called rated short time withstand current. Furthermore, the housing of this type of circuit interrupter is expensive and causes a problem in the inspection and maintenance of the interrupter contacts since the total mechanism is housed in a combination of a base and a cover.

There is another means for providing higher interrupting capacity for both the first and second types of interrupters. According to this means, a repulsive magnetic force between the movable contacts, produced by a heavy short circuit current, is utilized to obtain a quick separation of the contacts, making possible a high interrupting ability. However this type of circuit interrupter lacks the short time current withstand ability and is inadequate for use in system selectivity co-ordination.

In the case of any of the circuit interrupter types, it is necessary to obtain a high pressure arc at the contact area and to exhaust the arc gas through the arc extinguisher means to outside the opening of the arc chamber as quickly as possible in order to make possible a high interruption performance. Since the arc speed is generally limited by the existence of arc extinguisher means which act as a fluid dynamic resistance against the arc flow, the high pressure and smooth movement of the arc are highly effective in obtaining a high arc speed.

SUMMARY OF THE INVENTION

Accordingly, an object of the present invention is to provide a circuit interrupter having a rated short circuit interruption capacity which is substantially greater than that of the conventional air circuit interrupter and yet having a relatively simple structure.

Another object of the present invention is to provide a simple circuit interrupter exhibiting a higher rated short time withstand current capacity than that of conventional circuit interrupters.

Still another object of the present invention is to provide a circuit interrupter exhibiting a higher arc speed at the vicinity of the extinguisher means in order to obtain a higher rated short circuit capability.

Still another object of the present invention is to provide a circuit interrupter which has an insulating housing and yet which is easy to inspect and maintain.

Still another object of the present invention is to provide a circuit interrupter which has a small and inexpensive insulating housing compared to the existing circuit interrupters having a totally enclosing molded housing.

With the above objects in view, the circuit interrupter of the present invention comprises a contact structure including a pair of separable contacts which are connectable to an external circuit. The contact structure is substantially enclosed by an insulating housing so that, upon the separation of the contacts, the electric arc established between the separated contacts raises the internal pressure within the arcing region defined by the housing resulting in the arc gas flowing at high speed toward and through the arc extinguisher and an opening disposed one side of the insulating housing. Therefore, the ionized gas which is generated due to the high temperature arc collides with the non-ionized gas at a very high speed and is cooled by the arc extinguishing grids, resulting in the recombination of the cations and free electrons, which promotes the arc extinction. To achieve an effective gas flow toward the arc extinguisher, it is basically necessary to raise the pressure of the arc at the arcing region and to seal off parts other than the arc extinguisher as far as possible to prevent pressure leaks and to minimize the volume around the movable contacts needed to accommodate the movement thereof between open and closed positions. The interrupter includes an operating mechanism, which is insulated from line parts and usually grounded, for effecting contact opening and closing movements of the contact structure by insulated interconnecting means for transmitting the movements of the operating mechanism to the contact structure. The operating mechanism is located outside of the housing, while the interconnecting means extends through the insulating housing and operably interconnects the operating mechanism and the contact structure. The interconnecting means between the contact structure and the operating mechanism may comprise a flange or barrier which seals an opening in the housing through which the interconnecting means extends.

The circuit interrupter also comprises an arc extinguisher within the insulating housing. The arc extinguisher includes a plurality of arc grids, an arc gas mixing chamber and an arc gas cooling grid. The arc extinguisher may be disposed within an arc extinguisher cover made of an insulating material and detachably mounted to the housing body.

Since the operating mechanism is entirely located outside the housing, it is quite easy to design the housing to be of minimum volume or dimensions. It is required that the housing accept only the contact structure and the arc extinguisher means with appropriate margins for accommodating movement of the contacts.

Therefore, in the case of contact inspection, which is carried out very often for maintenance purposes, removal of the arc extinguisher only is required and inspection is quite as easy as in the case of conventional circuit interrupters of the first type. For the circuit interrupters of the second type, it is necessary to remove the cover for contact inspection which also exposes the arc extinguishers, contact assemblies and the operating mechanism.

The housing body is generally formed as an integral part of a molded base and a molded cover because of the necessities of production. When the circuit interrupter is of the multipole type, both the molded base and the molded cover can be an integrally formed unit with each pole.

BRIEF DESCRIPTION OF THE DRAWINGS

The present invention will become more readily apparent from the following description of the preferred embodiment of the invention taken in conjunction with the accompanying drawings, in which.

DESCRIPTION OF THE PREFERRED EMBODIMENT

Figure 1:
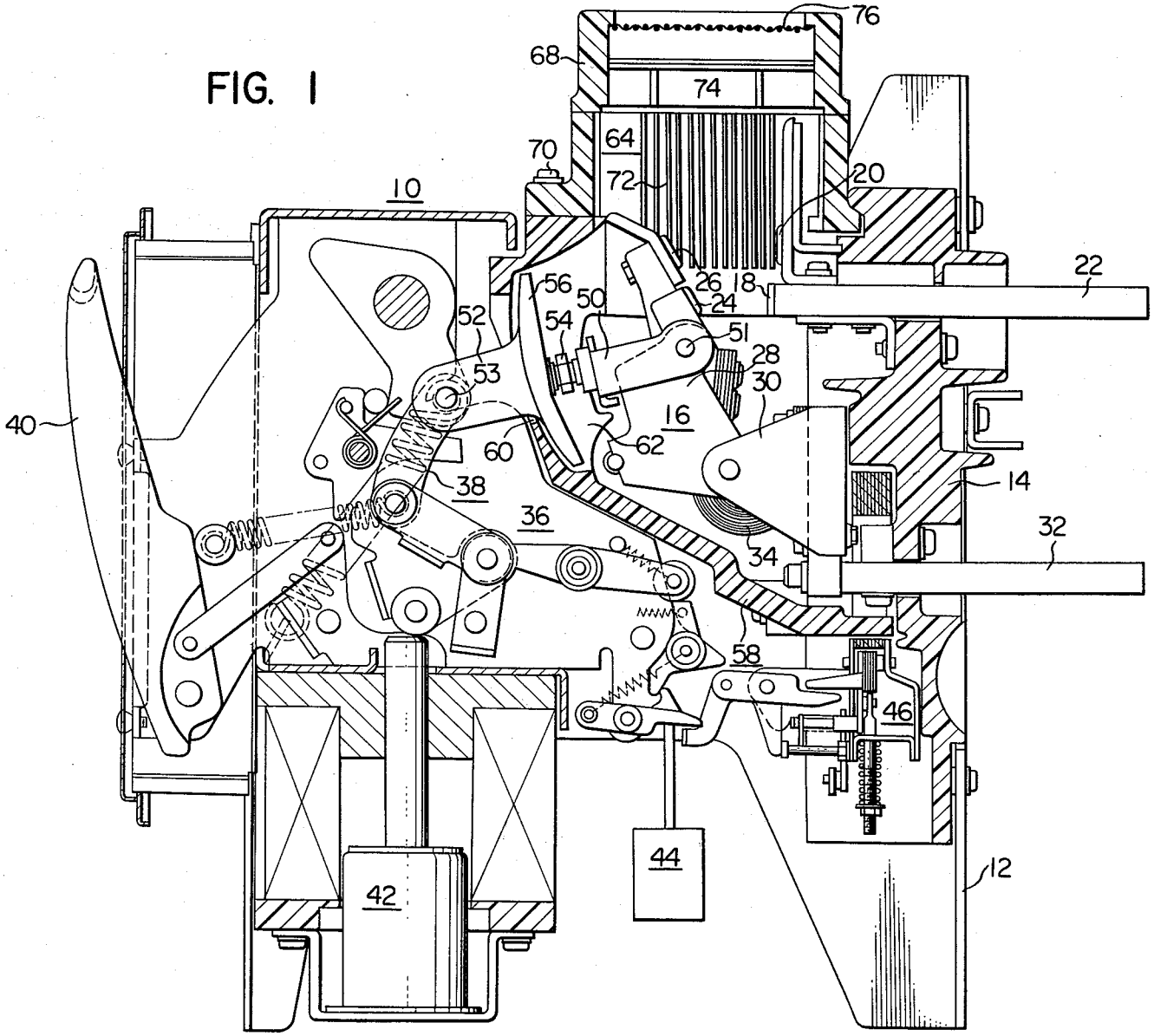
FIG. 1 is a sectional side view of the circuit interrupter of the present invention, with its contact structure and operating mechanism in their open positions.
Figure 2:
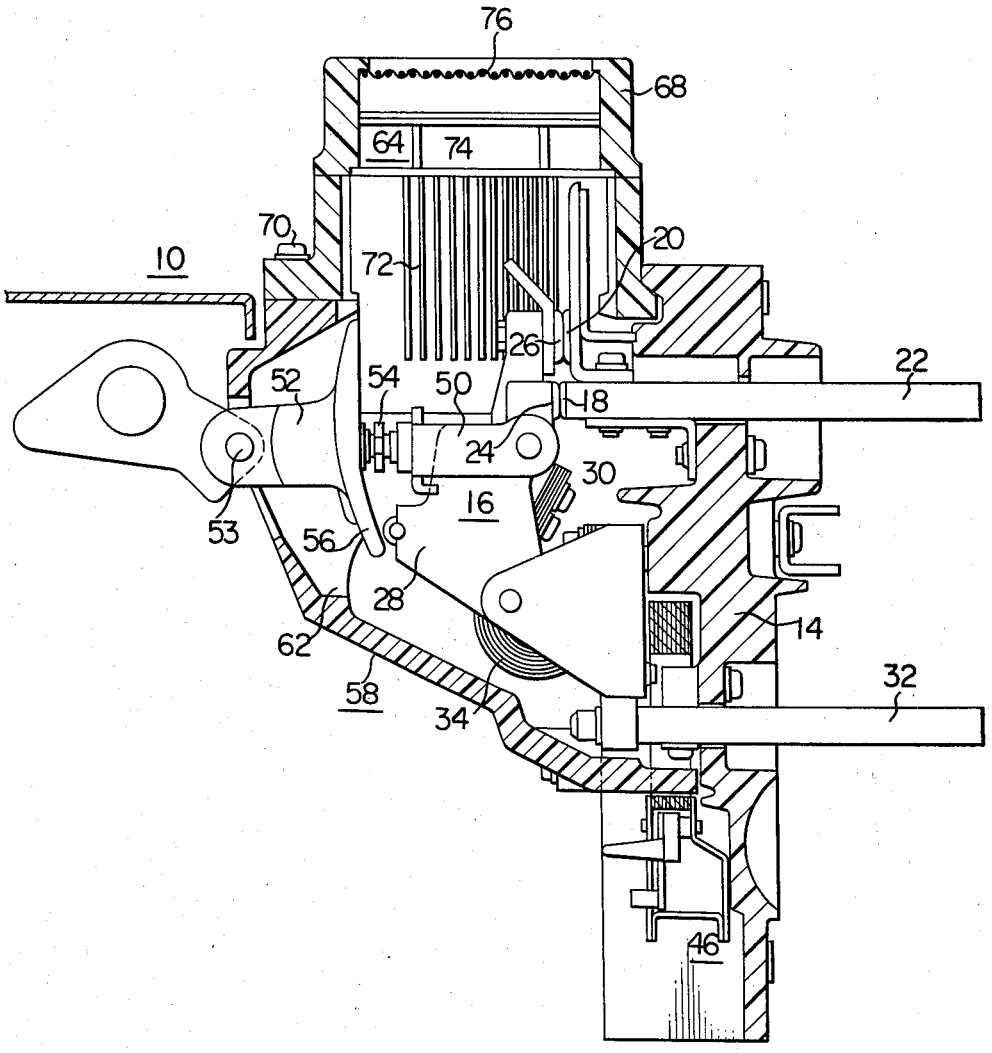
FIG. 2 is a sectional side view of a part of the interrupter shown in FIG. 1 with the contact structure in its closed position.
Figure 3:
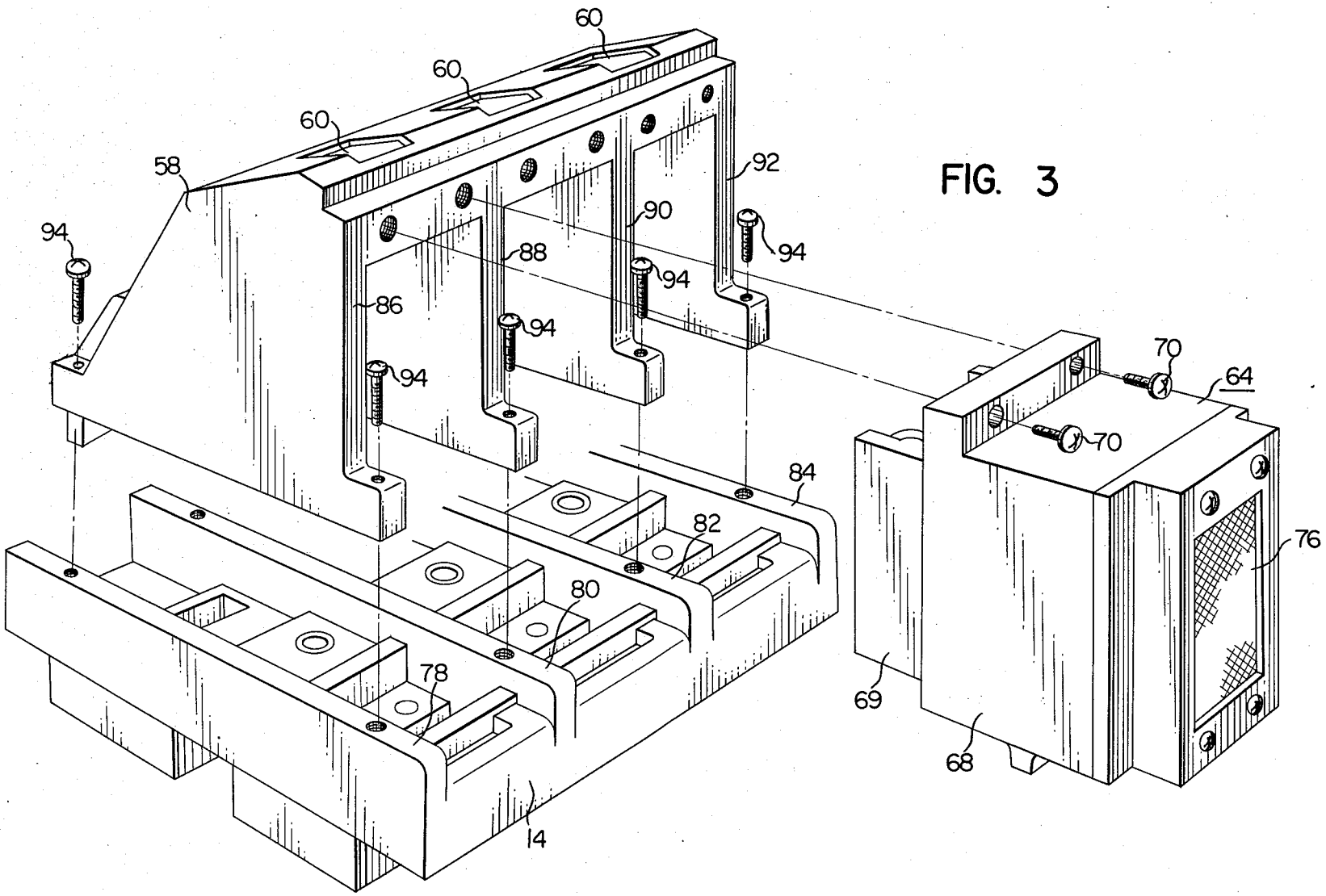
FIG. 3 is an exploded perspective view of the insulating housing used in the circuit interrupter shown in FIGS. 1 and 2.

Referring now to FIGS. 1 to 3 in which a circuit interrupter constructed in accordance with the present invention is illustrated, the circuit interrupter 10 comprises a metal frame 12, a molded base 14 secured to the metal frame 12, and a contact structure 16 mounted on the molded base 14. The contact structure 16 comprises a stationary main contact 18 and a stationary arcing contact 20, both mounted on and electrically connected to a source terminal 22. Terminal 22 is secured and extends through the molded base 14 for connection to an external circuit (not shown). The contact structure 16 also comprises a movable main contact 24 and a movable arcing contact 26, both mounted on a movable contact arm 28 which is pivotally supported on a bracket 30 which is in turn mounted on a load terminal 32 secured to and extending through the molded base 14 for connection to an external circuit (also not shown). A flexible conductor 34 is connected between the contact arm 28 and the bracket 30 to insure a good electrical connection therebetween.

The contact structure 16 is movable between the open contact position, as shown in FIG. 1, and the closed contact position, as shown in FIG. 2, by an operating mechanism 36 which is mounted on the metal frame 12. The operating mechanism 36 may be of a conventional design and may include toggle links 38, an operating handle 40, an electromagnetic throw-in mechanism 42, a tripping mechanism 44, and an over current instantaneous tripping mechanism 46, all of which may be of any conventional design. The operating mechanism 36 is connected electrically to a ground terminal (not shown), and when the circuit interrupter is in service conditions the mechanism 36 is always grounded, as usually practiced in the first type of circuit interrupters.

The contact structure 16 and the operating mechanism 36 are operatively interconnected by an interconnecting means which is composed of a contact lever 50 and an operating rod 52 made of a suitable insulating material. One end of the contact lever 50 is pivotably connected at 51 to the contact arm 28 and the other end of the lever 50 is connected to one end of the operating rod 52 through an adjusting nut 54 for adjusting the overall length of the assembled contact lever 50 and the operating rod 52. The other end of the operating rod 52 is pivotably connected at 53 to the toggle links 38. Thus, the movement of the operating mechanism 36 is transmitted through the interconnecting means to the contact structure 16. The operating rod 52 has a flange or barrier 56 for a purpose which will subsequently become apparent.

The circuit interrupter according to the present invention further comprises an electrically insulating cover 58 which is mounted on the molded base 14. It is to be noted that the insulating cover 58, together with the molded base 14, comprises the housing body and encloses the contact structure 16, while the operating mechanism 36 is not enclosed in the housing body. The cover 58 is designed to have the minimum dimensions around the contact structure 16 needed to accommodate the movement of the contact structure between its open and closed positions, so that the volume of the housing body is reduced and a quick pressure increase is obtained upon current interruption. The contact structure 16 is isolated by the insulating cover wall from the operating mechanism 36 at the clearance existing therebetween so that the dielectric strength therebetween is very high. This relatively simple arrangement enables the circuit interrupter of the present invention to have a high rated current capability for its size.

The cover 58 has formed therein an opening 60 through which the operating rod 52, used for interconnecting the contact structure 16 and the operating mechanism 36, movably extends. In order to allow the operating rod 52 to be substantially axially movable, the opening 60 is slightly larger than the outer dimensions of the operating rod 52, thus forming a small clearance gap between the outer surface of the rod 52 and the edge of the opening 60. This clearance gap is effectively sealed by the insulating flange or barrier 56 against the passage of the high pressure gas generated upon the current interruption. The insulating flange or barrier 56 may be integrally formed on the operating rod 52. It is to be noted that in order to effectively seal the opening against the passage of the gas, even when the contacts are in the closed position (FIG. 2) or in the almost-closed position, the insulating cover 58 has a thick portion 62 around the flange or barrier 56.

In the illustrated embodiment, an arc extinguisher 64 is disposed within an arc extinguisher cover 68 which is detachably attached to the housing body by any suitable means, such as screws 70. The cover 68 has therein a plurality of arc grids 72, an arc gas mixing chamber 74, and an arc gas cooling screen 76 which is located at an opening of the extinguisher cover 68. The housing body forms an opening enough to fit to an inlet of the extinguisher cover 68 so as to minimize gas leakage at this junction.

Thus the cover 58, the base 14, and the arc extinguisher cover 68 are integrally formed to constitute an insulating chamber housing comprising a contact chamber at one end and an extinguisher chamber at the other end, which contributes to a desirable gas pressure rise and gas flow in the case of a heavy current interruption.

In the preferred embodiment of the present invention, the insulating cover 58 is in the form illustrated in FIG. 3 . That is, the molded base 14 has three sections, one for each pole unit, which sections are separated from each other by vertical walls 78, 80, 82, 84 integral with the molded base 14.

The insulating cover 58 includes four partition walls 86, 88, 90 and 92 adapted to be fixedly attached to the vertical walls 78–84 on the molded base 14 by any suitable means, such as screws 94 to define the housing body. Therefore, the interior spaces of the housing body are isolated from each other by vertical walls 78–84 and 86–92. The openings 60 for allowing the operating rod 52 to pass therethrough are seen in the top of the cover 58 in FIG. 3.

The arc extinguisher cover 68 are detachably attached by screws 70 or the like to the open sides of the housing body with leg portions 69 inserted into the openings of the housing body.

Thus, when the circuit interrupter of the present invention is assembled, the contact structure 16, except portions of the terminals 22 and 32, is substantially completely enclosed by the insulating chamber housing composed of the molded base 14, the insulating cover 58, and the arc extinguisher cover 68, each interfitting with each other. The mechanical strength of the thus formed enclosure can be easily increased by increasing the thickness of the walls of the components or by employing a stronger material in order to accommodate the increased internal gas pressure due to the electric arc upon the current interruption.

If it is desired, each of the molded base 14 and the insulating cover 58 may be formed in three pieces each having two vertical walls, with the necessary modifications for multipole circuit interrupters. Alternatively, the arc extinguisher cover 68 may be formed of a single large piece having multipole arc extinguishing chambers integrally formed therein for multipole units.

In order to evaluate the present invention, the disclosed invention was applied to a conventional air circuit interrupter of the 2,000 A rating frame type with a rated short time withstanding current of 50 kA, 1 sec. at 500 V AC, and a rated short circuit breaking capacity of 50 kA, and it was found that a rated short circuit breaking capacity of 100 kA was achieved without changing the rated short time withstanding current of 50 kA, 1 sec., unlike a current limiting type circuit interrupter which requires a decrease in its rated short time withstanding current.

We claim as our invention:

1. A circuit interrupter having an uncovered operating mechanism and comprising:

a contact structure including a pair of separable contacts which are connectable to an external circuit;

an arc extinguisher which is disposed in a direct facing relationship with an electric arc established between said pair of separated contacts;

an electrically insulated chamber housing, having said contact structure together with said arc extinguisher disposed therein, and defining a contact chamber with said contact structure at one end and an arc extinguisher chamber with said arc extinguisher at the other end, and having a first opening for exhaust the arc gas at said arc extinguisher chamber side;

an operating mechanism, which is disposed exterior to said insulating chamber housing, for operating said contact structure; and interconnecting means, electrically isolating said operating mechanism from said contact structure and including an electrically insulating member movably extending through said insulating chamber housing, for operatively interconnecting but electrically insulating said contact structure and said operating mechanism, and for transmitting the movements of the operating mechanism to the contact structure;

said operating mechanism being groundable and also isolated from the contact structure by said insulating chamber housing at the clearance existing therebetween;

said insulating chamber housing substantially enclosing said contact structure with substantially the minimum dimensions necessary for accommodating the contact movement so as to promote the movement of a blast of ionized gas which has been generated by the electric arc established between said contacts from said insulating chamber housing to the exterior of said insulating chamber housing through said arc extinguisher and said first opening;

said arc extinguisher chamber being directly and fluid dynamically smoothly connected for at least substantially maintaining a smooth gas flow from said contact chamber.

2. A circuit interrupter as claimed in claim 1, wherein said insulating chamber housing comprises a housing body and an arc extinguisher cover, defining said contact chamber and said arc extinguisher chamber respectively, said housing body having a second opening large enough to fit to an inlet of said extinguisher cover and to provide an easy access to and inspection of said contacts when said arc extinguisher means is removed.

3. A circuit interrupter as claimed in claim 1 or 2, wherein said insulating chamber housing has formed therein an aperture for allowing said interconnecting means to movably extend therethrough, said interconnecting means being associated with an insulating barrier for substantially closing said aperture contained therein against the increased pressure within said insulating chamber housing upon separation of said pair of contacts.

4. A circuit interrupter as claimed in claim 1 or 2, wherein one of said pair of separable contacts is carried on a pivotable contact arm.

5. A circuit interrupter as claimed in claim 3, wherein one of said pair of separable contacts is carried on a pivotable contact arm.

* * * * *